US008115127B2

(12) United States Patent
Nguyen et al.

(10) Patent No.: US 8,115,127 B2
(45) **Date of Patent: *Feb. 14, 2012**

(54) EXTENDED DRIVE PLATE DELIBERATE ACTION ROTARY HANDLE

(75) Inventors: Huy Nguyen, Lilburn, GA (US); Sheenfar Fong, Lawrenceville, GA (US); Mark Blankemeyer, Suwanee, GA (US); Jose Hurtado, Peach Tree City, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 749 days.

This patent is subject to a terminal disclaimer.

(21) Appl. No.: 12/187,424

(22) Filed: Aug. 7, 2008

(65) Prior Publication Data

US 2009/0057118 A1 Mar. 5, 2009

Related U.S. Application Data

(60) Provisional application No. 60/968,926, filed on Aug. 30, 2007.

(51) Int. Cl.
*H01H 17/00* (2006.01)

(52) U.S. Cl. ..... 200/330; 200/50.01; 200/50.11

(58) Field of Classification Search ..... 200/17 R, 200/329–331, 43.11, 43.14, 50.01, 50.11
See application file for complete search history.

(56) References Cited

U.S. PATENT DOCUMENTS

| | | | | |
|---|---|---|---|---|
| 2,695,934 | A | 11/1954 | Wills | |
| 4,612,424 | A | 9/1986 | Clark et al. | |
| 5,821,487 | A | 10/1998 | Groves et al. | |
| 6,958,456 | B1 | 10/2005 | Jur et al. | |
| 7,368,675 | B2 * | 5/2008 | Ishido et al. | 200/331 |
| 7,560,654 | B2 * | 7/2009 | Blankemeyer et al. | 200/331 |
| 2005/0110747 | A1 | 5/2005 | Harley et al. | |

FOREIGN PATENT DOCUMENTS

| | | | |
|---|---|---|---|
| DE | 3901260 | A1 | 7/1989 |
| GB | 1257889 | A | 12/1971 |

* cited by examiner

*Primary Examiner* — Renee S Luebke
*Assistant Examiner* — Marina Fishman

(57) ABSTRACT

The present invention relates generally to a rotary handle. More particularly, the invention encompasses a deliberate action rotary handle. The invention further includes an extended drive-plate deliberate action rotary handle, such that to turn on a component, such as, a circuit breaker, requires a deliberate manual action by the user. If a deliberate action is not taken by a user but the handle is accidentally pushed then the handle does not engage with a drive shaft and the handle moves to an outer edge of a drive plate thus preventing the engagement of the handle with the other components to turn on the component.

23 Claims, 4 Drawing Sheets

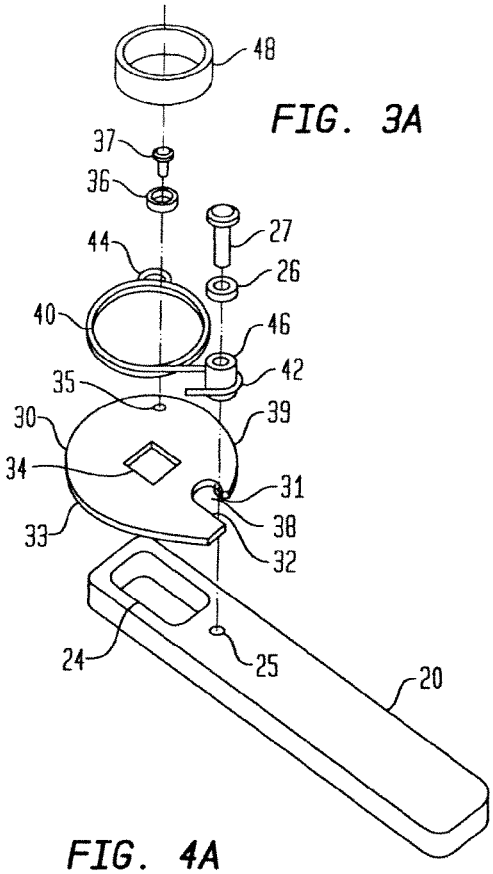
FIG. 3A
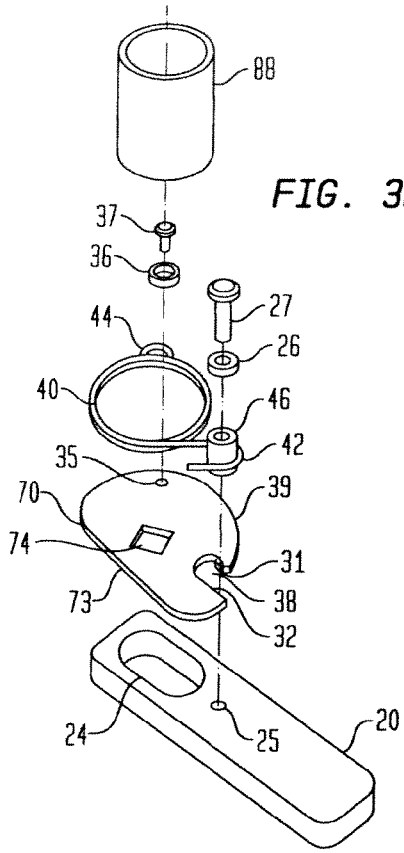
FIG. 3B
FIG. 4A
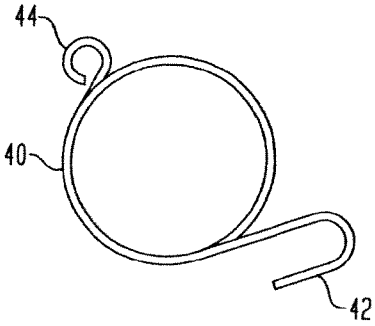
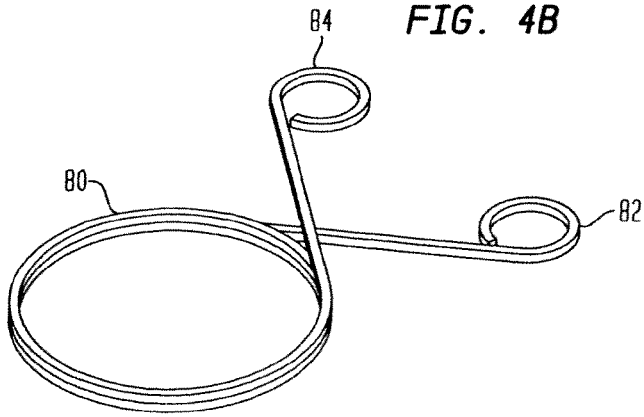
FIG. 4B

EXTENDED DRIVE PLATE DELIBERATE ACTION ROTARY HANDLE

CROSS-REFERENCE TO RELATED APPLICATION

The instant patent application is related to U.S. Provisional Patent Application Ser. No. 60/968,926, filed on Aug. 30, 2007, titled "Extended Driveplate Deliberate Action Rotary Handle," the disclosure of which is incorporated herein by reference.

FIELD OF THE INVENTION

The present invention relates generally to a rotary handle. More particularly, the invention encompasses a deliberate action rotary handle. The invention further includes an extended drive-plate deliberate action rotary handle, such that to turn on a component, such as, a circuit breaker, requires a deliberate manual action by the user. If a deliberate action is not taken by a user but the handle is accidentally pushed then the handle does not engage with a drive shaft and the handle moves to an outer edge of a drive plate thus preventing the engagement of the handle with the other components to turn on the component.

BACKGROUND INFORMATION

Circuit breakers, both single and multi-phase circuit breakers, typically include a lever or other device for manually operating the circuit breaker. Frequently, it is desirable that the lever be operated through the use of a mechanical interface, such as a direct mount rotary handle operating mechanism having a handle that may be manually operated, wherein the handle mechanism is of the type that is directly mounted to the circuit breaker.

In operation, the handle mechanism moves the circuit breaker lever to its various operative positions. This includes an "ON" position, an "OFF" position and a "RESET" position. In some instances, it is necessary to lock the handle mechanism in the OFF position so as to safeguard personnel working on associated equipment. However, when the electrical contacts of the circuit breaker have become welded closed, usually as a result of a short circuit condition, locking the handle mechanism in an OFF position would create a dangerous and inappropriate condition since a user would believe that the circuit breaker is in the OFF (electrical contacts open) condition, when in fact the electrical contacts are welded closed.

Conventional handle mechanisms include a locking portion that will not enable locking of the handle when the contacts are welded together. This is commonly referred to as "Suitable for Isolation" or "Positive OFF". In addition, the handle will return to indicate the ON position when the handle is released. These are safety features that indicate to the user that the contacts are welded and that substantially reduce the likelihood that others working on the equipment would mistakenly believe that the contacts are open.

However, conventional handle mechanisms rely on the proper positioning of the handle as a way of ensuring that it will not lock during Positive OFF. The disadvantage of such mechanisms is, that with wear, the position of the handle mechanism approaches the locked position. Further, such mechanisms rely on the force limits set by standard specifications, such as those set by the International Electrotechnical Commission (EC), in order to ensure the handle cannot be locked.

U.S. Pat. No. 6,969,813 (Michael Troy Winslett, et al.), the disclosure of which is incorporated herein by reference, discloses a direct mount rotary handle operating mechanism for operating a circuit breaker having electrical contacts. The handle mechanism includes a driver coupled to the circuit breaker and a handle having a socket for receiving the driver. The socket is configured to allow the handle to rotate relative to the driver. The handle further includes a movable locking pin. A lock latch is associated with the driver, wherein the lock latch includes a flange portion. When the electrical contacts of the circuit breaker are welded closed and a torque is applied to the handle, the handle rotates to a position in which the pin is blocked from being inserted into the locking hole by the flange portion thereby preventing the handle from being locked in an OFF position when the contacts are welded together.

U.S. Pat. No. 7,368,675 (Hideki Ishido, et al.), the disclosure of which is incorporated herein by reference, discloses an external operation handle device is used for a circuit breaker for switching a locker handle to ON and OFF positions. The handle device includes a main body casing for the circuit breaker, a mount base held on the main body casing, a rotary handle grip mounted on the mount base for turning the locker handle to the ON and OFF positions and having a connecting shaft, and an assist mechanism for moving the handle grip to a TRIP indication position upon tripping operation of the circuit breaker. The assist mechanism is interposed between the mount base and the handle grip, and includes a cam with a cam face, fixed on the mount base, a cam follower linking with the handle grip slidably along an axial direction and opposing the cam face of the cam, and an urging spring for pushing the cam follower against the cam face.

U.S. Pat. No. 7.399,934 (Takeshi Emura, et al.), the disclosure of which is incorporated herein by reference, discloses an external operation handle device for a circuit breaker includes a rotary handle equipped with a handle lock lever, a drive mechanism linking the rotary handle and the locker handle of the circuit breaker, and a door lock lever for interlocking between the rotary handle and a door of the board. By operating the rotary handle, the circuit breaker can be turned to an ON or OFF position, and the door is unlocked at an OPEN position. The handle lock lever is slidably disposed on the rotary handle to be anchored and held at a pulled out position in a condition where the rotary handle at the OPEN position unlocks the door of the board, and the door lock lever linked to the rotary handle is cramped and held at the unlock position in a condition where the rotary handle is at the OPEN position.

Furthermore, the National Fire Protection Association (NFPA) 79 standard calls for a means to operate a breaker's handle at all time. And this becomes an issue, especially, when the electrical enclosure door is either closed or is opened.

Thus, a need exists for a extended drive-plate deliberate action rotary handle.

This invention overcomes the problems of the prior art and provides a extended drive-plate deliberate action rotary handle, that engages a component, such as, a circuit breaker, only upon a deliberate action by an operator.

PURPOSES AND SUMMARY OF THE INVENTION

The invention is a novel extended drive-plate deliberate action rotary handle.

Therefore, one purpose of this invention is to provide a novel extended drive-plate deliberate action rotary handle.

Another purpose of this invention is to provide a extended drive-plate deliberate action rotary handle which requires a deliberate action to engage the handle to a component, such as, a circuit breaker.

Yet another purpose of this invention is to provide a extended drive-plate deliberate action rotary handle where an accidental movement of the handle moves the handle to move along an outer edge of a drive plate.

Still yet another purpose of the invention is to meet or exceed the requirement of National Fire Protection Association (NFPA) 79 standard.

Therefore, one aspect this invention comprises a rotary handle operating mechanism for operating an electrical component, comprising:

(a) a drive shaft coupled to said electrical component;
(b) a handle having an opening for receiving said drive shaft;
(c) a drive plate having an opening for receiving said drive shaft; and
(d) a torsion spring having a first end and a second end, and wherein said first end is secured to said drive plate, and wherein said second end is secured to said handle, and thereby providing said rotary handle operating mechanism for operating an electrical component.

Another aspect this invention comprises a rotary handle operating mechanism for operating an electrical component, comprising:

(a) a drive shaft coupled to said electrical component;
(b) a handle having an opening for receiving said drive shaft;
(c) a drive plate having an opening for receiving said drive shaft;
(d) a torsion spring having a first end and a second end, and wherein said first end is secured to said drive plate, and wherein said second end is secured to said handle,
(e) a cylinder secured to said handle, and wherein said cylinder is adapted to rotate about said second end of said torsion spring; and
(f) a drive shaft cylinder secured to said drive shaft, and wherein said torsion spring is adapted to rotate about said drive shaft cylinder, and thereby providing said rotary handle operating mechanism for operating an electrical component.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

FIG. 3A is an exploded view of an exemplary extended drive-plate deliberate action rotary handle components which is used to illustrate an embodiment of the present invention.

FIG. 3B is an exploded view of an exemplary extended drive-plate deliberate action rotary handle components which is used to illustrate another embodiment of the present invention.

FIG. 4A illustrates an embodiment of a torsion spring that is used in conjunction with an embodiment of extended drive-plate deliberate action rotary handle of the present invention.

FIG. 4B illustrates another embodiment of a torsion spring that is used in conjunction with an embodiment of extended drive-plate deliberate action rotary handle of the present invention.

DETAILED DESCRIPTION

The present invention provides a novel extended drive-plate deliberate action rotary handle. Shown in the Figures is a rotary handle operating mechanism in accordance with the present invention. The handle mechanism includes a base connected to a circuit breaker. The base includes a lock hole which is used with a lock hole on a moveable link member. The moveable link is moveably coupled to the base so that holes may be aligned to allow for the placement of a lock or similar other locking device. At one end of the moveable link member is a base handle which is moveably coupled to the linking member. The base handle or actuating arm has an opening which allows the shaft to be inserted therein. Rotation of the shaft cause the base handle to rotate and move the link member. A shaft support bracket is used to support and align the shaft with the base and the other components.

In addition, and as shown in the Figures is a torsion spring that may be used to provide an opposing force to the force applied to the bar handle. As shown the shaft is positioned through holes so as to connect with both the bar handle and drive plate. Two washer and screw assemblies are used. One of the washer and screw assemblies is connected to the drive plate and will function as one of the posts for the torsion spring. The other washer and screw assembly is connected to the bar handle. Note that the screw may be placed in a sleeve or cylinder made from, for example of metal or plastic or any other material that provides a smooth roll-able surface. To turn on the switch, which requires a deliberate action, the handle is pushed toward the shaft so as to place the cylinder closer to notch and thereby engage the cylinder with the drive plate on the "on" edge. To turn off the switch requires no deliberate action. Further illustrations of the rotary handle operating mechanism are shown in the FIGS. 1 through 8.

Trying to turn on the breaker without applying a radial force on the handle results in cylinder sliding over the shorter side of the notch on plate. Turning the breaker off does not require application of a radial handle force because the pin/cylinder interferes with the longer side of the notch on plate when turning in counterclockwise direction. Bracket also serves to limit the travel of handle when turning the breaker on.

Figure 1:
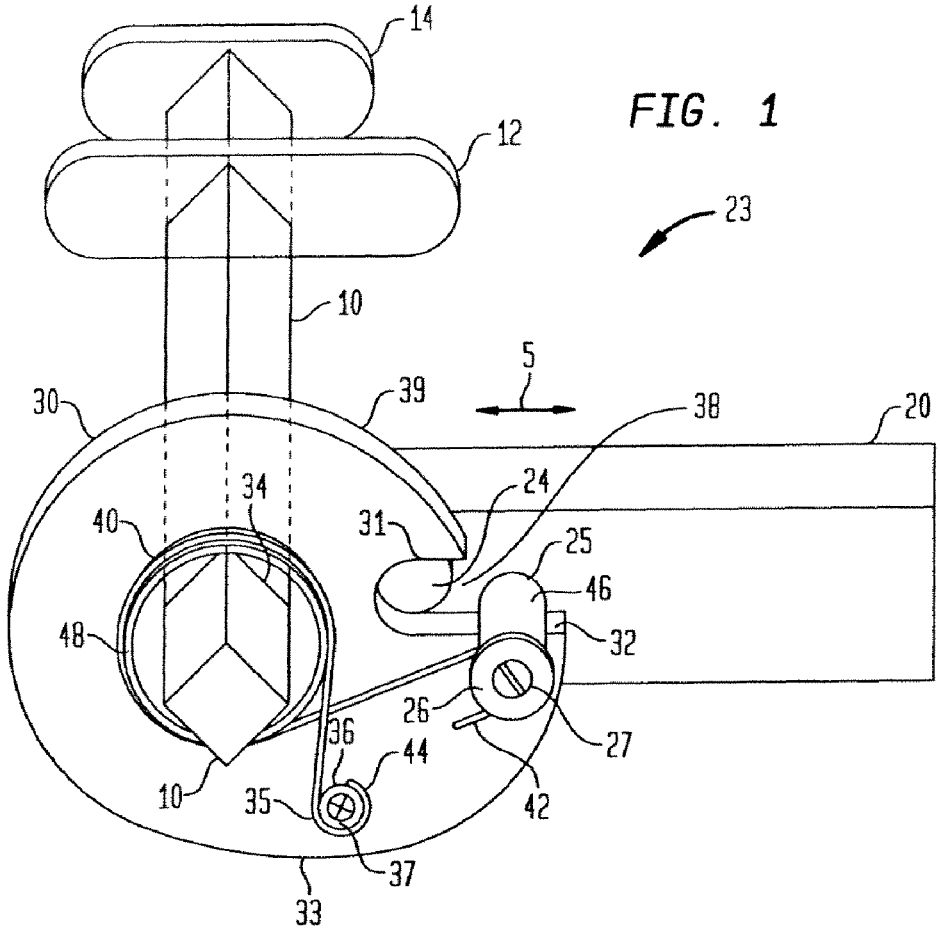
FIG. 1 is an exploded view of an exemplary extended drive-plate deliberate action rotary handle which is used to illustrate an embodiment of the present invention.

Referring now to FIGS. 1 through 8, and more specifically to FIG. 1 which is an exploded view of an exemplary extended drive-plate deliberate action rotary handle 23, which is used to illustrate an embodiment of the present invention. The extended drive-plate deliberate action rotary handle 23, has a handle 20, having at least one hole or opening 24, to accommodate at least one securing device 27, and at least a second hole or opening 24, to allow linear movement 5, or rotational movement 7, of the handle 20. A drive plate 30, having at least one hole or opening 35, to accommodate at least one securing device 37, and at least a second hole or opening 34, to allow the passage of a drive shaft 10. The drive plate 30, also has a groove 38, having an "ON" edge 31, an "OFF" edge 32, an outer edge 39, and a curved edge 33. A torsion spring 40, having a first upon securing loop or hook 42, and a second closed securing loop or hook 44, is placed adjacent the drive plate 30, such that the torsion spring 40, is loosely wrapped around a tube or a sleeve or a cylinder or a drive shaft cylinder 48, and that a securing device 37, such as, a screw 37, is made to pass through the securing loop 44, and is secured into the opening 35, of the drive plate 30. The securing device 27, such as, a screw 27, is made to pass through a tube or a sleeve or a cylinder 46, which is placed within the open securing loop or hook 42, and is secured into the opening 25, of the handle 20, such that, the cylinder 46, is within the groove 38, of the drive plate 30. For some applications it is preferred to have at least one washer 36, such as, a flat washer 36, between the securing device 37, and the securing hole 35, in the drive plate 30. Similarly, for some applications it is preferred to have at least one washer 26, such as, a flat washer 26, between the securing device 27, and the securing hole 25, in the handle 20. It should be appreciated that one end of the drive shaft is secured to a knob 14, having a knob base 12, while the another end of the drive shaft 10, is made to pass through the opening 24, the opening 30, and the cylinder 48, and is secured to a base handle or an actuating arm 50. The securing device 27, such as, a screw 27, also acts as a post for securing a first end of the torsion spring 40, to the handle 20. Similarly, the securing device 37, such as, a screw 37, also acts as a post for securing a second end of the torsion spring 40, to the drive plate 30.

Figure 2:
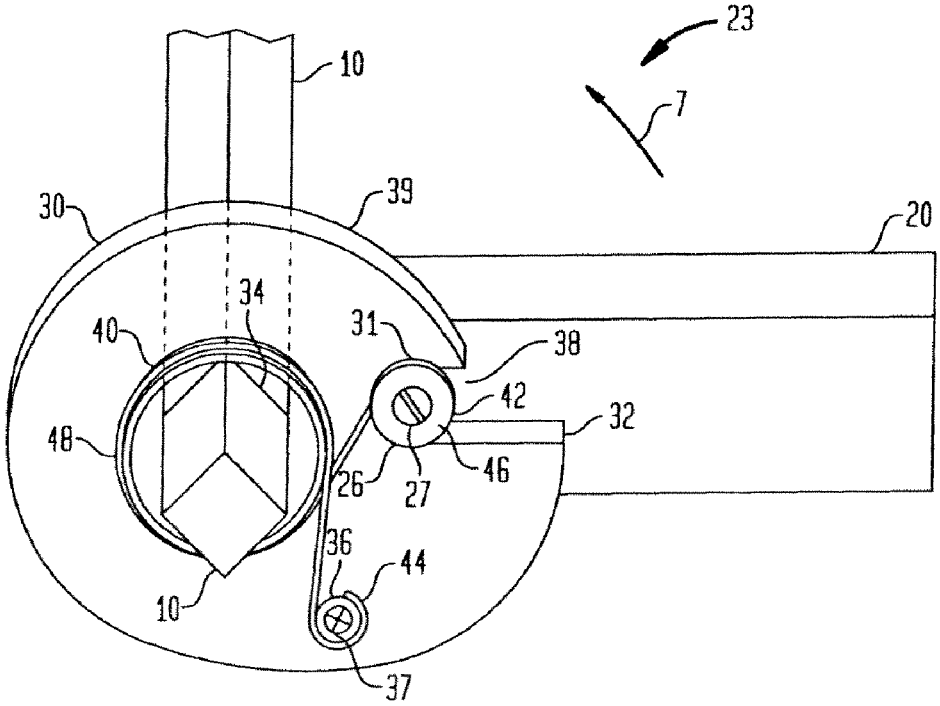
FIG. 2 is another exploded view of an exemplary extended drive-plate deliberate action rotary handle which is used to illustrate an embodiment of the present invention.

FIG. 2 is another exploded view of an exemplary extended drive-plate deliberate action rotary handle 23, which is used to illustrate an embodiment of the present invention. As can be seen in FIG. 2, the handle 20, has been linearly pushed inside the groove 38, and the cylinder 46, is at the "ON" edge 31. This requires deliberate action to push the handle 20, linearly inside the groove 38, and to be in a locked and in an "ON" position. However, if the handle 20, is moved from the "OFF" position while the cylinder 46, is at the "OFF" edge 32, of the drive plate 30, the cylinder 46, would not engage the drive plate 30, or the drive shaft 10, but would slide onto the outer edge 39.

As shown in FIG. 1, a breaker can be turned "OFF" anytime since in neutral position the cylinder 46, is always engaged to the "OFF" edge 32, of the drive plate 30. Furthermore, it should be appreciated that the torsion spring 40 or 80, always keeps the handle 20, in a neutral position, i.e., the cylinder 46, is along the "OFF" position or edge 32, and is not inside the groove 38, or in the "ON" position or edge 31, of the drive plate 30.

However, as shown in FIG. 2, after the cylinder 46, is moved into the groove 38, or into the "ON" position or edge 31, of the drive plate 30, an electrical component 60, such as, a circuit breaker 60, can now be turned on, since the cylinder 46, is now locked into the "ON" edge or position 31. The drive plate 30, will now rotate with the handle 20, and turn the drive shaft 10, which in turn turns "ON" the component 60, such as, the circuit breaker 60. However, as one can appreciate that in order to place the handle 20, in an "ON" position or edge 31, one must take deliberate action and push the handle 20, linearly into towards the drive shaft 10, and to move the cylinder 46, into the groove 38, and into "ON" position or edge 31.

However, if the handle 20, is not pushed linearly towards the drive shaft 10, first then the cylinder 46, will not be locked inside the groove 38, and will simply rotate along the outer edge 39, of the drive plate 30, and the component 60, will not turn "ON". And, also the drive plate 30, will not rotate with the handle 20.

Thus, in order to turn "ON" the component 60, requires a deliberate action, i.e. the handle 20, has to be pushed towards the drive shaft 10, so as to place the sleeve or cylinder 46, closer to the "ON" edge or position 31, and to thereby engage the sleeve or cylinder 46, with the "ON" edge or position 31, of the drive plate 30. However, in order to turn "OF" or "Disengage" the handle 20, no deliberate action is required as the torsion spring 40, would slide or move the handle 20, back to the "OFF" edge or position 32. Thus, the handle 20, cannot be accidentally turned "ON" but it can be turned "OFF" anytime, as the cylinder 46, is always spring loaded to engage in the "OFF" position or edge 32, of the drive plate 30.

FIG. 3A is an exploded view of an exemplary extended drive-plate deliberate action rotary handle components which is used to illustrate an embodiment of the present invention. As one can see that the hole or opening 34, in the drive plate 30, is smaller than the hole or opening 24, and this difference allows the drive shaft 10, to be in snug contact with the drive plate 30, but be in a free position within the opening 24. Thus only the deliberate action of the handle 20, in a linear direction 5, engages the handle 20, with the drive shaft 10, and then the rotational movement 7, of the handle 20, rotates or moves the drive shaft 10, along with the drive plate 30. In this embodiment the drive plate 30, is shown with a curve edge 33.

FIG. 3B is an exploded view of an exemplary extended drive-plate deliberate action rotary handle components which is used to illustrate another embodiment of the present invention. The components are similar to the ones shown in FIG. 3A, however, the tube or the sleeve or the cylinder or the drive shaft cylinder 88, is longer, the drive plate 70, has a flat edge 73, and a hole or an opening 74, for the drive shaft 10, is at a different location in the drive plate 70.

FIG. 4A illustrates an embodiment of a torsion spring 40, that is used in conjunction with an embodiment of extended drive-plate deliberate action rotary handle 23, of the present invention. The torsion spring 40, has an open securing loop or hook 42, and a closed securing loop or hook 44. In this embodiment the open securing loop or hook 42, and the closed securing loop or hook 44, are shown curling in an outwardly direction.

The torsion spring 40, provides several advantages, for example, the open securing hook or loop 42, on the torsion spring 40, allows the ease of the linear action 5, of the handle 20. The open securing loop or hook 42, also allows some sliding of the cylinder 46, within the hook 42, when the handle 20, is pushed toward the drive shaft 10, for the deliberate engagement to the "on" edge 31, of the drive plate 30, to deliberately turn on the breaker.

FIG. 4B illustrates another embodiment of a torsion spring 80, that is used in conjunction with an embodiment of extended drive-plate deliberate action rotary handle 23, of the present invention. The torsion spring 80, has a first closed securing loop or hook 82, and a second closed securing loop or hook 84. In this embodiment the first loop or hook 82, and the second closed securing loop or hook 84, are shown curling in an inwardly direction.

One of the purposes of the torsion spring 40 or 80, is to keep the handle 20, in alignment with the "OFF" edge or position 32, of the drive plate 30 or 70. Another purpose of the torsion spring 40 or 80, is to make the handle maintain its radial position with respect to the drive shaft 10.

Figure 5:
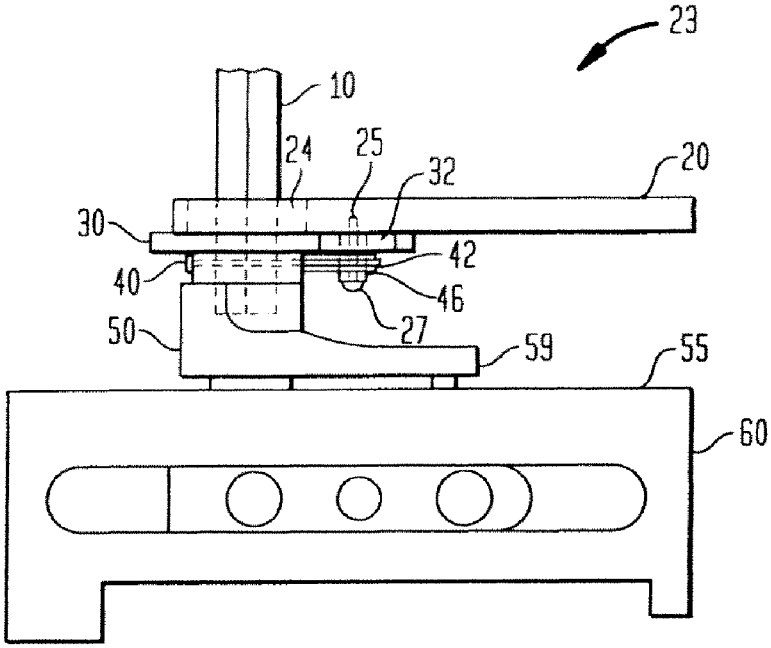
FIG. 5 is an exploded side view of an exemplary extended drive-plate deliberate action rotary handle components of the present invention.

FIG. 5 is an exploded side view of an exemplary extended drive-plate deliberate action rotary handle 23, components of the present invention. As shown in FIG. 5, the drive shaft 10, is secured to a base handle 50, and base 55.

Figure 6:
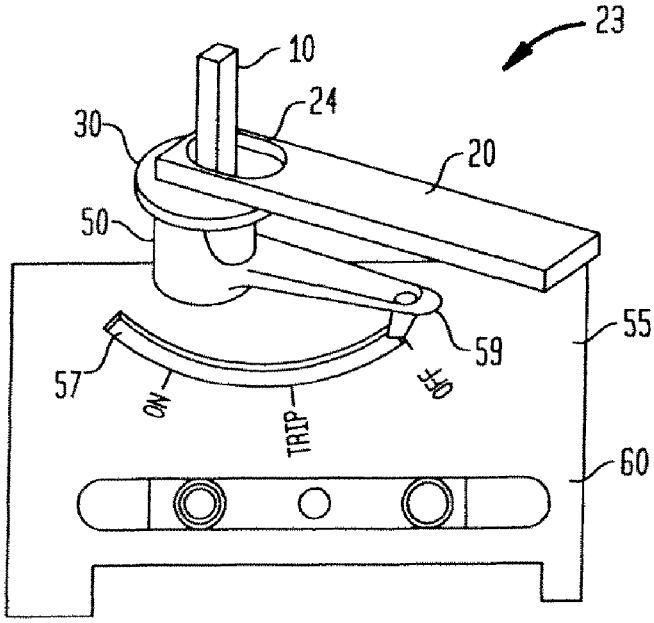
FIG. 6 is an exploded perspective view of an exemplar extended drive-plate deliberate action rotary handle components of the present invention.

FIG. 6 is an exploded perspective view of an exemplary extended drive-plate deliberate action rotary handle 23, components of the present invention. The base 55, has at least one opening 57, which allows a moveable link member 59, secured to the base handle 50, to rotate inside the opening 57, and to be able to place the base components in various settings, such as, for example, "ON" position or setting, "OFF" position or setting, "TRIP" position or setting, to name a few. Thus, the rotational movement 7, of the drive shaft 10, will cause the actuating arm or the base handle 50, to rotate and will thus move the moveable link member 59.

Figure 7:
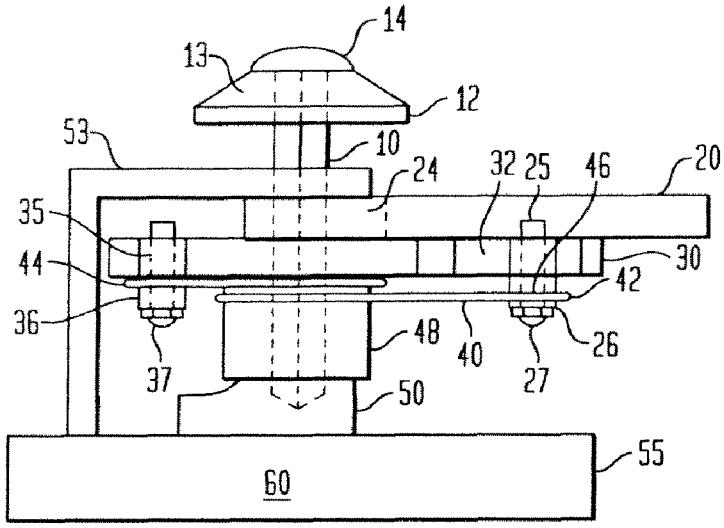
FIG. 7 is an exploded side view of an exemplary extended drive-plate deliberate action rotary handle components of the present invention.

FIG. 7 is an exploded side view of an exemplary extended drive-plate deliberate action rotary handle 23, components of the present invention. It is preferred that at least one securing device 53, such as, a shaft support bracket 53, supports and secures the drive shaft 10, to the base 55. It should be appreciated that the shaft support bracket 53, allows the rotational movement 7, of the drive shaft 10, but prevents the linear movement 5, of the drive shaft 10.

Figure 8:
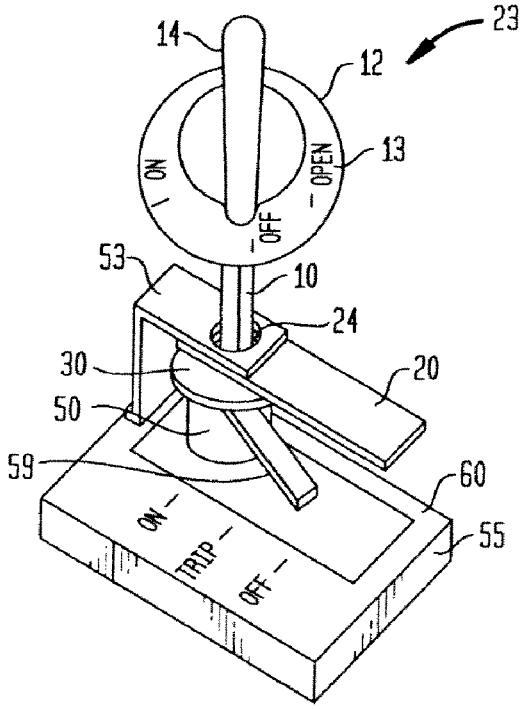
FIG. 8 is an exploded perspective view of an exemplary extended drive-plate deliberate action rotary handle components of the present invention.

FIG. 8 is an exploded perspective view of an exemplary extended drive-plate deliberate action rotary handle 23, components of the present invention. It is preferred that the knob base 12, has markings 13, such as, for example, for an "ON" position or setting, an "OFF" position or setting, an "OPEN" position or setting, to name a few.

For some applications an electrical enclosure door (not shown) is provided to provide a door or cover to the component 60. For such applications, the shaft 10, usually protrudes through the cover or enclosure door. For such applications after the enclosure door is closed, the knob base 12, and the knob 14, are then secured to the shaft 10, so that they are on the outside of the enclosure door and are easily accessible by an operator. However, when the electrical enclosure door is opened, the knob base 12, and the knob 14, are either disengaged or removed from the drive shaft 10, and during such situations the system no longer satisfies NFPA79 standard. However, with this invention one always meets the NFPA 79 standard, even when the means to operate the breaker's handle when the enclosure door is opened and the outside knob 14, is not there.

The material for the tube or the sleeve or the cylinder 46, 48 and 88, are preferably selected from a group comprising plastic material, nylon material, Teflon material, metallic material, bimetallic material, composite material, and combination thereof, to name a few. It is preferred that the surface the sleeve or the cylinder 46, 48 and 88, that provides rotational movement be smooth and have a roll-able surface.

The material for the drive plate 30 and 70, are preferably selected from a group comprising plastic material, nylon material, Teflon material, metallic material, bimetallic material, composite material, and combination thereof, to name a few.

The material for the handle 20, are preferably selected from a group comprising plastic material, nylon material, Teflon material, metallic material, bimetallic material, composite material, and combination thereof, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A rotary handle operating mechanism for operating an electrical component, comprising:

a drive shaft coupled to said electrical component;

a handle having an opening receiving said drive shaft and an engagement member;

a drive plate having at least one groove having an ON edge and an OFF edge, the drive plate also having an opening receiving and engaging said drive shaft; and a torsion spring having a first end and a second end, and wherein said first end is secured to said drive plate, and wherein said second end is secured to said handle, and thereby providing said rotary handle operating mechanism for operating an electrical component;

wherein the engagement member is adapted to move in the groove between the ON edge and the OFF edge.

2. The rotary handle operating mechanism of claim 1, wherein said electrical component is selected from a group consisting of an actuator and a circuit breaker.

3. The rotary handle operating mechanism of claim 1, wherein said first end of said torsion spring forms a closed hook, and wherein said second end of said torsion spring forms an open hook.

4. The rotary handle operating mechanism of claim 1, wherein said engagement member is adapted to be inserted into said second end of said torsion spring.

5. The rotary handle operating mechanism of claim 1, wherein a drive shaft cylinder is secured to said drive shaft, and wherein said torsion spring is adapted to rotate about said drive shaft cylinder.

6. The rotary handle operating mechanism of claim 1, wherein said handle is adapted to rotate from a first position to a second position relative to said drive shaft.

7. The rotary handle operating mechanism of claim 6, wherein said first position is between about 0 degrees to about 90 degrees relative to said drive shaft.

8. The rotary handle operating mechanism of claim 1, wherein when engaged said handle rotates in unison with said drive plate.

9. The rotary handle operating mechanism of claim 1, wherein material for said engagement member is selected from a group consisting of plastic material, nylon material, Teflon material, metallic material, bimetallic material, composite material, and combination thereof.

10. The rotary handle operating mechanism of claim 1, wherein material for said drive shaft cylinder is selected from a group consisting of plastic material, nylon material, Teflon material, metallic material, bimetallic material, composite material, and combination thereof.

11. The rotary handle operating mechanism of claim 1, wherein material for said drive plate is selected from a group consisting of plastic material, nylon material, Teflon material, metallic material, bimetallic material, composite material, and combination thereof.

12. The rotary handle operating mechanism of claim 1, wherein material for said handle is selected from a group consisting of plastic material, nylon material, Teflon material, metallic material, bimetallic material, composite material, and combination thereof.

13. A rotary handle operating mechanism for operating an electrical component, comprising:

a drive shaft coupled to said electrical component;

a handle having an opening receiving said drive shaft;

a drive plate having at least one groove having an ON edge and an OFF edge, the drive plate also having an opening receiving and engaging said drive shaft;

a torsion spring having a first end and a second end, and wherein said first end is secured to said drive plate, and wherein said second end is secured to said handle, a cylinder secured to said handle, and wherein said cylinder is adapted to move in the groove between the ON edge and the OFF edge; and a drive shaft cylinder secured to said drive shaft, and wherein said torsion spring is adapted to rotate about said drive shaft cylinder, and thereby providing said rotary handle operating mechanism for operating an electrical component.

14. The rotary handle operating mechanism of claim 13, wherein said electrical component is selected from a group consisting of an actuator and a circuit breaker.

15. The rotary handle operating mechanism of claim 13, wherein said first end of said torsion spring forms a closed hook, and wherein said second end of said torsion spring forms an open hook.

16. The rotary handle operating mechanism of claim 13, wherein said handle is adapted to rotate from a first position to a second position relative to said drive shaft.

17. The rotary handle operating mechanism of claim 16, wherein said first position is between about 0 degrees to about 90 degrees relative to said drive shaft.

18. The rotary handle operating mechanism of claim 13, wherein when engaged said handle rotates in unison with said drive plate.

19. The rotary handle operating mechanism of claim 13, wherein material for said cylinder is selected from a group consisting of plastic material, nylon material, Teflon material, metallic material, bimetallic material, composite material, and combination thereof.

20. The rotary handle operating mechanism of claim 13, wherein material for said drive shaft cylinder is selected from a group consisting of plastic material, nylon material, Teflon material, metallic material, bimetallic material, composite material, and combination thereof.

21. The rotary handle operating mechanism of claim 13, wherein material for said drive plate is selected from a group consisting of plastic material, nylon material, Teflon material, metallic material, bimetallic material, composite material, and combination thereof.

22. The rotary handle operating mechanism of claim 13, wherein material for said handle is selected from a group consisting of plastic material, nylon material, Teflon material, metallic material, bimetallic material, composite material, and combination thereof.

23. A rotary handle operating mechanism for operating an electrical component, comprising:

a drive shaft coupled to said electrical component;

a handle having an opening receiving said drive shaft;

a drive plate having an opening receiving said drive shaft; and a torsion spring having a first end and a second end, and wherein said first end is secured to said drive plate, and wherein said second end is secured to said handle, and thereby providing said rotary handle operating mechanism for operating an electrical component;

wherein the handle includes an engagement member adapted to be inserted into said second end of said torsion spring and further adapted to move into and out of a groove in said drive plate.

* * * * *